US011598342B2

(12) United States Patent
Wu

(10) Patent No.: US 11,598,342 B2
(45) Date of Patent: Mar. 7, 2023

(54) HEAT DISSIPATION FAN OF MAGNETIC SUSPENSION STRUCTURE

(71) Applicant: Chin-Ping Wu, Taoyuan (TW)

(72) Inventor: Chin-Ping Wu, Taoyuan (TW)

( * ) Notice: Subject to any disclaimer, the term of this patent is extended or adjusted under 35 U.S.C. 154(b) by 23 days.

(21) Appl. No.: 17/337,445

(22) Filed: Jun. 3, 2021

(65) Prior Publication Data

US 2022/0389932 A1 Dec. 8, 2022

(51) Int. Cl.

| | |
|---|---|
| ***F04D 25/08*** | (2006.01) |
| ***F04D 25/06*** | (2006.01) |
| ***F04D 29/26*** | (2006.01) |
| ***F04D 29/52*** | (2006.01) |

(52) U.S. Cl.

CPC ..... *F04D 25/0633* (2013.01); *F04D 25/062* (2013.01); *F04D 25/08* (2013.01); *F04D 29/263* (2013.01); *F04D 29/522* (2013.01)

(58) Field of Classification Search

CPC .... F04D 19/002; F04D 25/0653; F04D 25/08; F16C 39/06; F16C 39/063; F16C 2370/12; F16C 2360/46; F16C 17/045; F16C 17/047; F16C 17/102–107

See application file for complete search history.

(56) References Cited

U.S. PATENT DOCUMENTS 6,231,800 B1 * 5/2001 Togashi ..... B29C 45/73 264/331.12
6,290,471 B1 * 9/2001 Horng ..... F04D 29/023 417/423.12
7,884,512 B2 * 2/2011 Horng ..... B23K 1/0016 310/67 R
2007/0128022 A1 * 6/2007 Yeh ..... F04D 29/023 415/220
2007/0145842 A1 * 6/2007 Zhu ..... F04D 29/582 310/43
2009/0047148 A1 * 2/2009 Chen ..... F04D 29/668 415/200

(Continued)

OTHER PUBLICATIONS

What are Ferrous Alloys?, by metaltek.com, published Nov. 2020, URL: https://www.metaltek.com/blog/what-are-ferrous-alloys/ (Year: 2020).*

(Continued)

*Primary Examiner* — Thomas Fink
(74) *Attorney, Agent, or Firm* — Leong C. Lei

(57) ABSTRACT

A heat dissipation fan of a magnetic suspension structure includes a fan frame, a fan blade assembly, a motor coil, a PCB, and an iron plate. The fan frame incudes a base portion and a circumferential wall portion. A central portion of the base portion is raised to form a central shaft. An assembling space is provided between an outer circumference of the central shaft and the circumferential wall portion. The motor coil is arranged in the assembling space and mounted to the central shaft and is electrically connected to the PCB to acquire electrical power. The fan blade assembly includes a hub portion including an axle core and blades extending radially from the hub portion. The fan blade assembly is rotatably mounted in the fan frame with the axle core mounted into a shaft formed in the central shaft. The rubber magnet encloses a circumference of the motor coil.

9 Claims, 2 Drawing Sheets

(56) References Cited

U.S. PATENT DOCUMENTS

| | | | | |
|---|---|---|---|---|
| 2009/0232678 | A1* | 9/2009 | Yang | F04D 25/062 417/410.1 |
| 2010/0157566 | A1* | 6/2010 | Bogursky | H01L 23/552 361/816 |
| 2014/0294621 | A1* | 10/2014 | Narita | F04D 25/0646 417/354 |
| 2017/0210961 | A1* | 7/2017 | Mason | C08G 18/227 |
| 2019/0003485 | A1* | 1/2019 | Nogamida | H02K 5/24 |
| 2020/0139594 | A1* | 5/2020 | Cumings | C08G 77/20 |
| 2021/0095693 | A1* | 4/2021 | Uchino | F04D 29/4226 |

OTHER PUBLICATIONS

What are Ferrous Alloys, by material-properties.org, downloaded Oct. 2022, URL: https://www.metaltek.com/blog/what-are-ferrous-alloys/ (Year: 2022).*

* cited by examiner

HEAT DISSIPATION FAN OF MAGNETIC SUSPENSION STRUCTURE

TECHNICAL FIELD OF THE INVENTION

The present invention relates to the field of heat dissipation fans, and more particularly to a magnetic-attraction fashion heat dissipation fan.

DESCRIPTION OF THE PRIOR ART

In the contemporary technology, for a heat dissipation fan to achieve the purpose of reducing vibration of fan blades in an axial direction during rotation in order to keep the fan blades rotating in a balance and stable manner, it is a common practice to include a magnetic element that pulls the fan blades downward through attracting. Magnetic suspension fans that are currently available in the market adopt a structure in which an iron plate is placed on a printed circuit board (PCB), which is retained in position by being fixed on a wire frame of a motor. Such an arrangement has various drawbacks:

(1) The iron plate has to be tightly positioned on the PCB and this would occupy a large amount of space available on the PCB, making it necessary for electronic components to avoid it by being re-arranged as components surface-mounted on two sides. This leads to an increase of the SMT (Surface-Mounting Technology) cost.

(2) The iron plate must be pre-formed with holes for positioning on the wire frame and a sensing hole for a Hall IC of the fan. This makes the entire iron plate no longer a complete circle, and the magnetic attraction forces that they apply to the fan blades would be of different strengths.

(3) Positioning the iron plate during assembling is complicated and tedious and is expensive. Further, such an arrangement of the iron plate being exposed to the outside makes it easy to oxidize, leading to reduced reliability.

SUMMARY OF THE INVENTION

In order to alleviate and overcome the above-discussed drawbacks and insufficiency of the magnetic-attraction fan, the present invention provides a novel improvement in respect of the structure by designing a heat dissipation fan having a magnetic suspension structure.

To achieve the above objective, the present invention provides the following technical solution:

A heat dissipation fan of a magnetic suspension structure is provided, wherein the fan comprises:

a fan frame, the fan frame being a plastic object, the fan frame comprising a base portion and a circumferential wall portion enclosing the base portion, the base portion having a central portion that is raised upward to form a central shaft, the central shaft being formed with a shaft bore;

a motor coil, the motor coil being mounted on an outer circumference of the central shaft and is conductively connected to a printed circuit board (PCB);

a fan blade assembly, the fan blade assembly comprising a hub portion and blades extending outward from the hub portion in a radial direction, the hub portion being provided with an axle core and a rubber magnet, the fan blade assembly being mounted, in a rotatable manner, in the fan frame in such a way that the axle core is in alignment with and mounted into the shaft bore of the central shaft, the rubber magnet being arranged to surround and enclose a circumference of the motor coil; and an iron plate, the iron plate being fixed to the base portion of the fan frame through injection molding such that an orthographic projection of the rubber magnet is cast on the iron plate, wherein interaction among the rubber magnet, the motor coil, and the iron plate creates an operation environment of magnetic suspension and magnetic attraction, and the fan blade assembly is operated for rotating in such an operation environment.

The above technical solution is further such that the iron plate is fully enclosed and embedded in the base portion of the fan frame.

The above technical solution is further such that the iron plate is partially enclosed and fixed in the base portion of the fan frame and is partially exposed at an inside surface or an outside surface of the base portion.

The above technical solution is further such that a magnet is provided on the base portion of the fan frame, and the magnet and the iron plate are staggered with respect to each other, and the magnet is coaxial with the axle core of the fan blade assembly, the magnet magnetically attracting the axle core of the fan blade assembly.

The above technical solution is further such that the iron plate is in the form of a circular ring, and the magnet is located in an inscribed circular area of the iron plate, the magnet having an outside diameter that is greater than a diameter of the axle core.

The above technical solution is further such that the axle core of the fan blade assembly is mounted into the shaft bore that is formed in advance in the central shaft by means of a hydraulic self-oiling bearing.

The above technical solution is further such that a wear-resistant pad is provided on an inner bottom of the shaft bore, and the wear-resistant pad support an inserted end of the axle core to abut thereto.

The above technical solution is further such that the rubber magnet is made by homogeneously adding magnetic powder in a rubber material and is forced into an iron casing using a fixture to form a closed circular ring rubber piece, which is further subject to high voltage magnetization to have the magnetic powder aggregating in the rubber material to form the north and south poles, this providing a fixed annular magnetic field; and the motor coil is made, through varying different wiring impedance, to form a varying magnetic field that is changeable, wherein the fixed annular magnetic field covers the varying magnetic field, generating magnetic suspension effect through mutual attraction and mutual expulsion.

The present invention adopts an arrangement of using a rubber magnet in combination with an iron plate to realize an effect of magnetic attraction, and further, the iron plate is directly fixed, through molding, to the base portion during the molding operation of the base portion of the fan frame so as to not only simplify the assembling of the iron plate, making the fabrication easy and reducing fabrication cost, but also ensure integrity and reliability of components, such as a PCB, ensuring the operability and the service life of the heat dissipation fan. Further, fixing the iron plate through the injection molding operation allows easy setting of the distance and strength of magnetic attraction as desired for the purposes of adjusting the effect of magnetic attraction, and also, through setting of the assembling sizes of a motor coil and the rubber magnet, an upward magnetic levitation or suspension force may be generated and applied to the motor coil during the operation of the fan blade assembly, wherein when the two forces of magnetic suspension and magnetic attraction reach a balance point, the fan blade assembly is held in a suspended magnetic field and such a magnetic field structure greatly reduces the friction between the axle core and bearing, thereby reducing noise of the fan and extending the service life of the fan.

DETAILED DESCRIPTION OF THE PREFERRED EMBODIMENT

Figure 1:
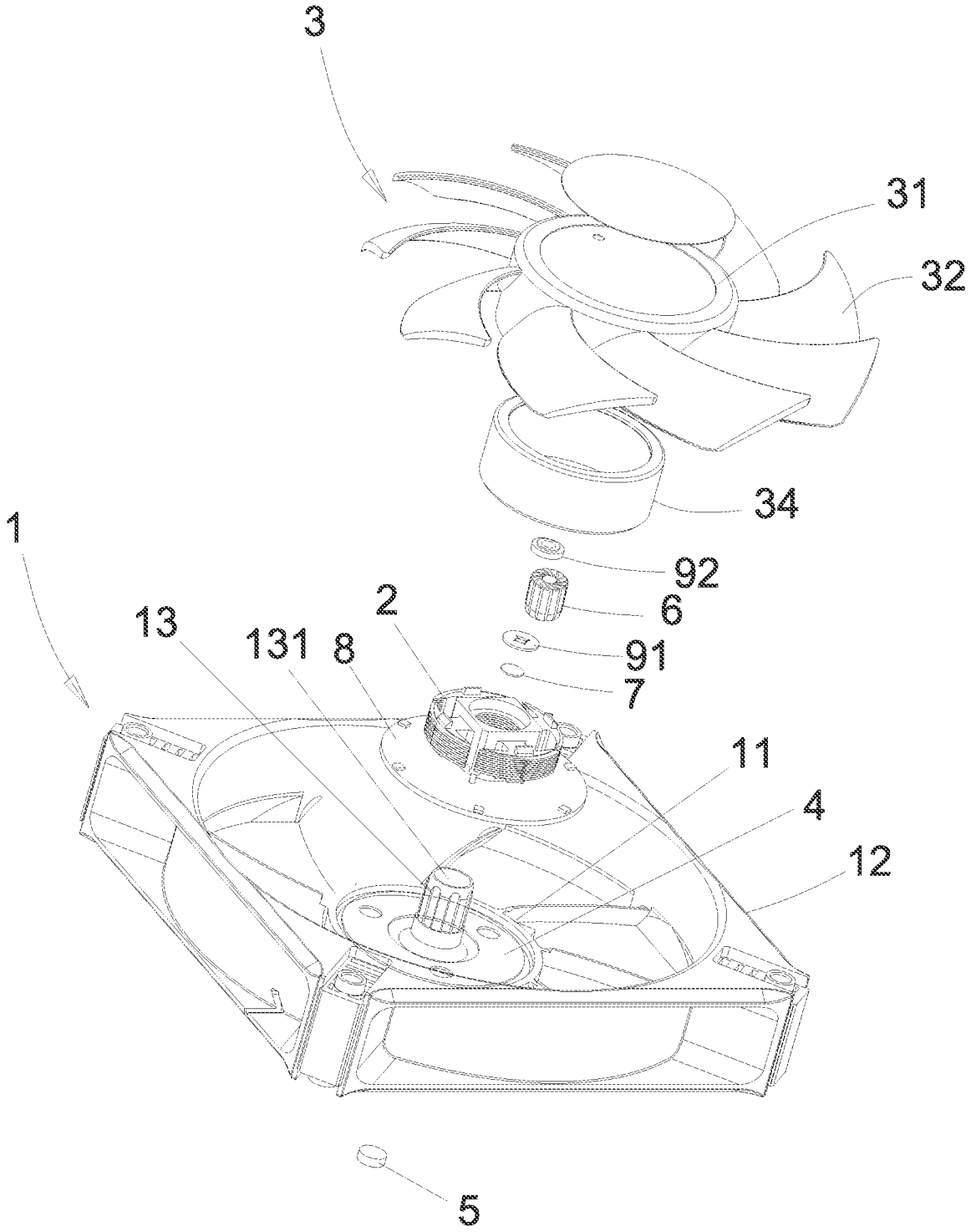
FIG. 1 is a perspective view showing a structure according to an embodiment of the present invention.
Figure 2:
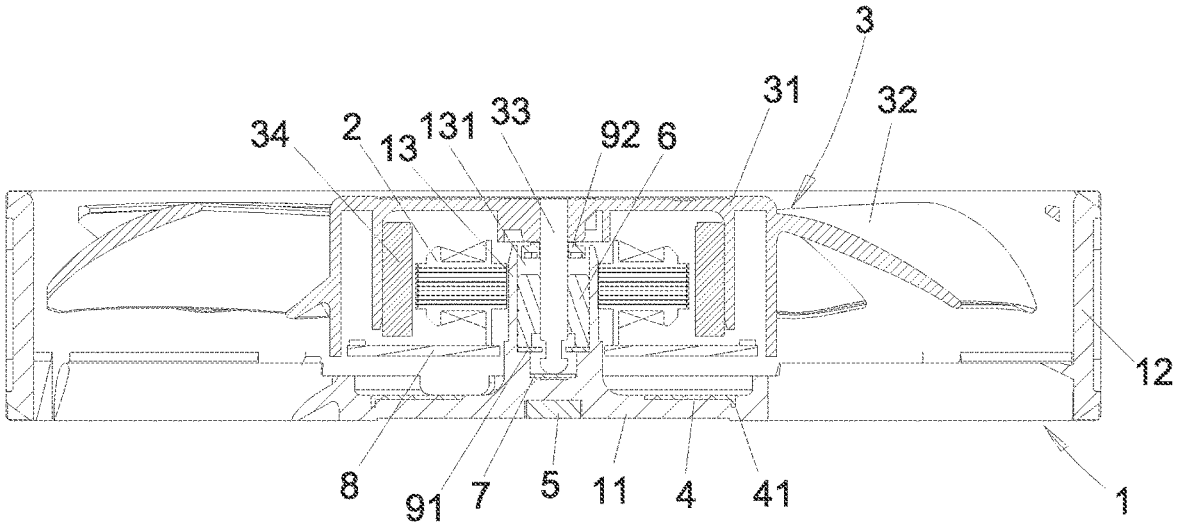
FIG. 2 is a cross-sectional view showing the structure of the first embodiment shown in FIG. 1 in an assembled form.
Figure 3:
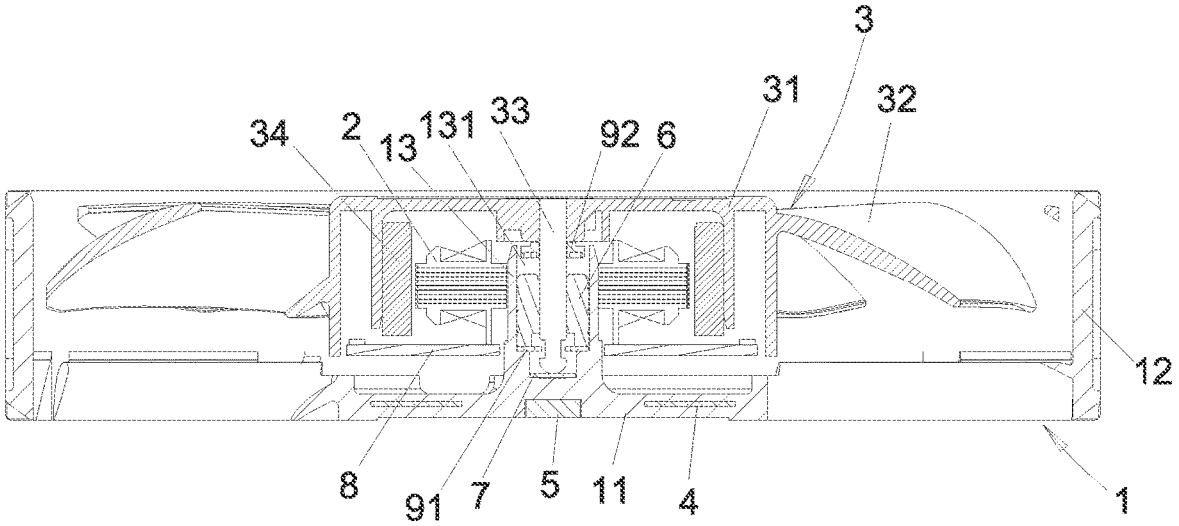
FIG. 3 is a cross-sectional view showing a structure of a second embodiment of the present invention in an assembled form.

Referring to FIGS. 1-3, which are drawings illustrating preferred embodiments of the present invention, the present invention relates to a heat dissipation fan of a magnetic suspension structure, which comprises a fan frame 1, a fan blade assembly 3, a motor coil 2, a printed circuit board (PCB) 8, and an iron plate 4. The fan frame 1 is a plastic piece, which is integrally formed as one piece or is manufactured through assembling separately fabricated parts together. The fan frame 1 comprises a base portion 11 and a circumferential wall portion 12 circumferentially enclosing the base portion 11. The base portion 11 has a central portion that is upward raised to form a central shaft 13. The central shaft 13 is formed with a shaft bore 131. An assembling space is provided between an outer circumference of the central shaft 13 and the circumferential wall portion 12. The motor coil 2 is arranged in the assembling space and is fixed to the outer circumference of the central shaft 13. The motor coil 2 is conductively connected to the PCB 8 to acquire electrical power. In the instant embodiment, the motor coil 2 and the PCB 8 are combined together a one-piece structure to be subsequently mounted in the fan frame 1. The fan blade assembly 3 includes a hub portion 31 and blades 32 extending outward from the hub portion 31 in a radial direction. The hub portion 31 is provided with an axle core 33 and a rubber magnet 34. The fan blade assembly 3 is mounted, in a rotatable manner, to the fan frame 1 in such a way that the axle core 33 is set in alignment with and mounted into the shaft bore 131 of the central shaft 1. The rubber magnet 34 is arranged to surround and enclose a circumference of the motor coil 2, so that an alternately varying magnetic field generated by the motor coil 2 may be applied to drive the fan blade assembly 3. The working principle of rotating of the fan blade assembly 3 is known and a description will be omitted. The iron plate 4 is fixed to the base portion 11 of the fan frame 1 through a process of injection molding, such that an orthographic projection of the rubber magnet 34 is cast on the iron plate 4. The magnetic attraction induced between the iron plate 4 and the rubber magnet 34 may help reduce axial vibration generated during the rotation of the fan blade assembly, allowing the fan blade assembly to rotate in a balanced and stable manner, thereby achieving a magnetic attraction fashion heat dissipation fan. The iron plate 4 is directly fixed, by means of molding, to the base portion during the molding of the base portion of the fan frame, this simplifying the assembling of the iron plate, making the fabrication easy and reducing the fabrication cost, and also guaranteeing integrity and reliability of components, such as the PCB, ensuring operability and service life of the heat dissipation fan. Interaction among the rubber magnet, the motor coil, and the iron plate creates an operation environment of magnetic suspension and magnetic attraction, and the fan blade assembly is operated for rotating in such an operation environment. The rubber magnet 34 is made by homogeneously adding magnetic powder in a rubber material and is forced into an iron casing using a fixture to form a closed circular ring rubber piece, which is further subject to high voltage magnetization to have the magnetic powder aggregating in the rubber material to form the north and south poles, this providing a fixed annular magnetic field. The motor coil 2 is made, through varying different wiring impedance, to form a varying magnetic field that is changeable. In this way, the fixed annular magnetic field covers the varying magnetic field, generating magnetic suspension effect through mutual attraction and mutual expulsion to improve the operation performance of the fan blade assembly.

Referring to FIGS. 1 and 2, in the instant embodiment, the iron plate 4 is fixed to the base portion 11 of the fan frame 1 by adopting a partially enclosed arrangement and is partially exposed at an inside surface of the base portion 11 and, as an alternative, can also be exposed at an outside surface of the base portion 11. In the illustration of the drawing, to enhance the effectiveness of fixation, the iron plate 4 is provided with a bent portion 41 that is bent in a direction into the interior of the base portion 11 to realize a function of gripping and increasing a contact surface and depth for plastic injection. It is also possible, as shown in FIG. 3, to embed the iron plate 4 deeply inside the base portion 11 of the fan frame 1 by adopting a fully enclosed arrangement. A specific way of implementation can be selected according to actual needs to adjust the effect of magnetic attraction based on distance and strength of magnetic attraction, in combination with setting of assembling sizes of the motor coil and the rubber magnet to apply an upward magnetic suspension force to the motor coil during the operation of the fan blade assembly, such that when the two forces of magnetic suspension and magnetic attraction reach a balance point, the fan blade assembly is held in a suspended magnetic field. Such a magnetic field structure greatly reduces the friction between the axle core and bearing, thereby reducing noise of the fan and extending the service life of the fan.

Referring to FIGS. 1-3, in the instant embodiment, the base portion 11 of the fan frame 1 is further provided with a magnet 5, and the magnet 5 and the iron plate 4 are shifted away from each other or stagger with respect to each other and thus misalign. Further, the magnet 5 is arranged coaxial with and the axle core 33 of the fan blade assembly 3. The magnet 5 magnetically attracts the axle core 33 of the fan blade assembly 3. The magnet 5 increases the magnetic attraction effect to the fan blade assembly, particularly for a product of high-speed fan that generates a greater magnetic suspension force, to ensure balanced and stable rotation of the fan blade assembly. In the instant embodiment, the iron plate 4 is in the form of a circular ring, and the magnet 5 is located in an inscribed circular area of the iron plate 4. The magnet 5 has an outside diameter that is greater than a diameter of the axle core 33. The axle core 33 is preferably made of a metallic material in order to provide a bettered effect of magnetic attraction.

Referring to FIGS. 1-3, in the instant embodiment, the axle core 33 of the fan blade assembly 3 is mounted into the shaft bore 131 of the central shaft 13 by means of a hydraulic self-oiling bearing 6. The hydraulic self-oiling bearing 6 has one end that is provided with a retention ring 91 to be retained to the axle core 33, and an opposite end of the hydraulic self-oiling bearing 6 is provided with an oil return roller 92. Such a structure ensures proper combination of the axle core 33 and the hydraulic self-oiling bearing 6 and guarantees the service life. The shaft bore 131 has an inner bottom that is provided with a wear-resistant pad 7. The wear-resistant pad 7 is provided for supporting an inserted end of the axle core 33 to abut thereon. Structurally, a state-of-the-art hydraulic self-oiling bearing is used, and such a bearing a made of copper metallurgy technology available from Japan, containing at least 90% of copper, making the material approaching the wear-resistant hardness of a full-copper material, and is used in combination with the state-of-the-art nanometer grade graphene oil to greatly improve the properties of the lubricant in respect of temperature resistance and oxidization resistance to thereby help improve the service life and silencing performance of the heat dissipation fan.

The present invention adopts an arrangement of using a rubber magnet in combination with an iron plate to realize an effect of magnetic attraction, and further, the iron plate is directly fixed, through molding, to the base portion during the molding operation of the base portion of the fan frame so as to not only simplify the assembling of the iron plate, making the fabrication easy and reducing fabrication cost, but also ensure integrity and reliability of components, such as a PCB, ensuring the operability and the service life of the heat dissipation fan. Further, fixing the iron plate through the injection molding operation allows easy setting of the distance and strength of magnetic attraction as desired for the purposes of adjusting the effect of magnetic attraction, and also, through setting of the assembling sizes of a motor coil and the rubber magnet, an upward magnetic levitation or suspension force may be generated and applied to the motor coil during the operation of the fan blade assembly, wherein when the two forces of magnetic suspension and magnetic attraction reach a balance point, the fan blade assembly is held in a suspended magnetic field and such a magnetic field structure greatly reduces the friction between the axle core and bearing, thereby reducing noise of the fan and extending the service life of the fan.

I Claim:

1. A heat dissipation fan of a magnetic suspension structure, comprising:

a fan frame, the fan frame being a plastic object, the fan frame comprising a base portion and a circumferential wall portion enclosing the base portion, the base portion having a central portion that is raised upward to form a central shaft, the central shaft being formed with a shaft bore;

a motor coil, the motor coil being mounted on an outer circumference of the central shaft and is conductively connected to a printed circuit board (PCB);

a fan blade assembly, the fan blade assembly comprising a hub portion and blades extending outward from the hub portion in a radial direction, the hub portion being provided with an axle core and a rubber magnet, the fan blade assembly being mounted, in a rotatable manner, in the fan frame in such a way that the axle core is in alignment with and mounted into the shaft bore of the central shaft, the rubber magnet being arranged to surround and enclose a circumference of the motor coil; and an iron plate, the iron plate being fixed to the base portion of the fan frame through injection molding such that an orthographic projection of the rubber magnet is cast on the iron plate, wherein the iron plate is in alignment with rubber magnet in a vertical direction to generate a first magnetic force in the vertical direction acting between the base portion of the fan frame to which the iron plate is fixed and the fan blade assembly on which the rubber magnet is arranged, wherein a second magnetic force is generated between the rubber magnet and the motor coil and magnetic interaction among the rubber magnet, the motor coil, and the iron plate creates an operation environment of magnetic suspension and magnetic attraction induced by the first and second magnetic forces, and the fan blade assembly is operated for rotating in such an operation environment, wherein the iron plate and the PCB are arranged such that the iron plate is separated from the PCB and the rubber magnet and the iron plate are located on two opposite sides of the PCB to correspond to each other in the vertical direction, and wherein the iron plate is fully enclosed and embedded in the base portion of the fan frame.

2. The heat dissipation fan of a magnetic suspension structure according to claim 1, wherein the iron plate is partially enclosed and fixed in the base portion of the fan frame and is partially exposed at an inside surface or an outside surface of the base portion.

3. The heat dissipation fan of a magnetic suspension structure according to claim 1, wherein a second magnet is provided on the base portion of the fan frame, and the second magnet and the iron plate are staggered with respect to each other in the vertical direction, and the second magnet is coaxial with the axle core of the fan blade assembly, the second magnet magnetically attracting the axle core of the fan blade assembly.

4. The heat dissipation fan of a magnetic suspension structure according to claim 3, wherein the iron plate is in the form of a circular ring having an inner opening, and the magnet is located in alignment in the vertical direction with the inner opening of the iron plate in the vertical direction, the second magnet having an outside diameter that is greater than a diameter of the axle core.

5. The heat dissipation fan of a magnetic suspension structure according to claim 1, wherein the axle core of the fan blade assembly is mounted into the shaft bore that is formed in advance in the central shaft by means of a hydraulic self-oiling bearing.

6. The heat dissipation fan of a magnetic suspension structure according to claim 5, wherein a wear-resistant pad is provided on an inner bottom of the shaft bore, and the wear-resistant pad supporting an inserted end of the axle core abutting thereto.

7. The heat dissipation fan of a magnetic suspension structure according to claim 3, wherein the axle core of the fan blade assembly is mounted into the shaft bore that is formed in advance in the central shaft by means of a hydraulic self-oiling bearing.

8. The heat dissipation fan of a magnetic suspension structure according to claim 7, wherein a wear-resistant pad is provided on an inner bottom of the shaft bore, and the wear-resistant pad supporting an inserted end of the axle core abutting thereto.

9. The heat dissipation fan of a magnetic suspension structure according to claim 1, wherein the rubber magnet is made by homogeneously adding magnetic powder in a rubber material and then forcing the rubber material and magnetic powder into an iron casing using a fixture to form a closed circular ring rubber piece, which is further subject to high voltage magnetization to have the magnetic powder aggregating in the rubber material to form the north and south poles, this providing a fixed annular magnetic field; and the motor coil forms a varying magnetic field that is changeable, wherein the fixed annular magnetic field covers the varying magnetic field, generating magnetic suspension effect through mutual attraction and mutual expulsion.

* * * * *